United States Patent [19]

Kimura et al.

[11] Patent Number: 5,020,786

[45] Date of Patent: Jun. 4, 1991

[54] PAPER INSERTING APPARATUS

[75] Inventors: Akira Kimura, Suita; Osamu Tomita, Osaka; Tetsuji Tomimoto; Satoru Fujita, both of Hyogo; Masami Kanemoto, Ibaragi, all of Japan

[73] Assignee: Kanzaki Paper Manufacturing Co., Ltd., Tokyo, Japan

[21] Appl. No.: 399,905

[22] Filed: Aug. 29, 1989

[30] Foreign Application Priority Data

| | | | |
|---|---|---|---|
| Aug. 31, 1988 | [JP] | Japan | 63-218846 |
| Mar. 28, 1989 | [JP] | Japan | 1-77559 |
| Apr. 28, 1989 | [JP] | Japan | 1-50988[U] |

[51] Int. Cl.[5] ..... B65H 45/22

[52] U.S. Cl. ..... 270/95; 414/789.5

[58] Field of Search ..... 270/95, 52, 55, 57, 270/58, 59; 414/789.5

[56] References Cited

U.S. PATENT DOCUMENTS

| | | | |
|---|---|---|---|
| 3,458,186 | 7/1969 | Schmidt | 270/95 |
| 4,749,179 | 6/1988 | Hornung | 414/789.5 |

FOREIGN PATENT DOCUMENTS

| | | | |
|---|---|---|---|
| 57-27861 | 2/1982 | Japan | 270/95 |
| 64-103658 | 7/1989 | Japan . | |

*Primary Examiner*—John T. Kwon

*Assistant Examiner*—Therese M. Newholm

*Attorney, Agent, or Firm*—Morgan & Finnegan

[57] ABSTRACT

A paper inserting apparatus comprises a guide bar having a flat guide path containing an upper and a lower surfaces extending parallel to and facing each other for the inserting tape supplied from its source, a tape pusher equipped to the guide bar so as to move slidably thereon within a defined range in the guide path, the tape pusher having an engaging device movable through the guide path for engaging the tape from both the upper and a lower sides by being inserted to the guide path through the upper and lower surfaces, and an elongated flexible elastic sheet or "leaf" which can slide the lower surface of the tape on the guide path and folds and drives the free portion of the tape protruded from the end edge of the guide path so that a portion of the tape is inserted by a defined distance into the sheet area on the upper exposed surface of the top sheet of the stack, reciprocal drive unit operatively connected to the tape pusher for sliding it within the defined range, and a non-return blade provided in the rear portion of the guide path which prevents the backward movement of it so that only the elongated leaf is moved backward together with the pusher and the free portion of the tape including the folded portion is remained in the insertion position.

3 Claims, 9 Drawing Sheets

PAPER INSERTING APPARATUS

The present invention relates to an improvement in a paper inserting apparatus for inserting intermittent portions of continuous paper tape in a trap configuration to the end of a cut sheet pile on a platform after cutting from an web material into a defined form and a defined dimension, for every defined number of sheets to be ready for packaging defined number of sheets in the succeeding process.

BACKGROUND OF THE INVENTION

Conventionally, the sheet materials such as paper, plastic, fabric, metal foil, etc. are cut into a defined dimension with a cutting apparatus such as a sheet cutter and a Guillotine cutter and, if required, defectives are removed by a defect-detecting apparatus or through a visual inspection by an inspector, and a defined number of sheets is divided as one unit (referred to as a "stacklet" hereinafter) and packaged and shipped.

Therefore, an automatic paper inserting apparatus has been widely used to insert paper tape strips (only referred to as "tape" hereinafter) at every defined number of cut sheets sent to the platform continuously and piled on the platform. However, the conventional apparatus utilizes a procedure of cutting the tape supplied continuously at every insertion. Consequently, an insertion to an erronous number of sheets and also a complete penetration of the tape between the cut sheets can occur due to the irregularity of the piling of the cut sheets and due to mutual adhesion of the piled cut sheets.

In some cases, the tape pushed for insertion slips away in failure to be inserted or the length of insertion is too short to be held between the sheets with no slippage from the side of the stack.

Therefore, the worker (or the supervisor) takes care for the discovery of these errors during the packaging of the cut sheets and the selection of defectives. However, they are sometimes overlooked and it becomes especially a big problem when the inserted tape penetrates between the cut sheets.

Thus, in the case where the stacklet is fed to the printer with the tape being penetrated between the cut sheets, the penetrated tape undesirably adheres to the printing plate to injure it.

Hence, the applicant of the present invention had filed an invention of "a paper inserting apparatus" as Japanese Utility Model Application No. 198,750 of 1987. The application is directed to an apparatus in which an elongated flexible leaf element (hereinafter referred simply as "elongated leaf") supported by a reciprocal drive mechanism so as to be guided to the position of insertion through a guide path together with the tape is provided and the end of the elongated leaf is pressed on one side of the continuous tape at the position of insertion to form a fold on the tape and thus to insert the tape in a trap configuration. Such a constitution has an excellent characteristic for solving the above-mentioned difficulties.

However, in the continuous use for a long period of the paper inserting apparatus of the above-memtioned constitution, several difficulties can occur at times in the guide path 101*a* of the guide bar 101 shown in the attached FIGS. 15 to 17 (corresponding to FIGS. 1 to 3 of the above application) such that the elongated leaf 102 may be bent by the compression due to the pushing force applied to its back end and also on the friction between it and the path surface, or that the trapped insertion portion of the continuous tape 104 inserted at every stacklet of the defined number of sheets in the end wall surface 103*b* of the stack 103 of the cut paper sheets 103*a*.

As mentioned above, in the case where the difficulty of bending the elongated blade occurs, it is countermeasured by stopping the operation of the apparatus, removing the inserting apparatus causing the error and replacing it by a new one. However, no product can be manufactured during the stoppage of the apparatus to decrease largely the yield of the product.

In the case of the difficulty that the tape is slipping from the side wall of the stack, the worker should transfer the stack on the platform once to another place and check if the number of the cut sheets at the site where the insertion is slipped out is as defined to give a heavy charge on the worker.

By an investigation of the cause of these difficulties, the followings was found as the causes. As shown in FIG. 17, a pusher 106 driven by the first air cylinder 105 is used to push the elongated leaf 102 and the tape 104. When this pusher is moved forward, an engaging lever 107 pivottably mounted on the pusher 106 is rotated counterclockwise by the pushing nut 108 equipped to the end of the rod 105*a* and thus the end edge 107*c* of the engaging lever presses the tape to the wall of the guide path 101*a* and slides it and moves together with the pusher 106 pushed by the support shaft 105*a* to push forward the tape together with the pushing of the folded front end by the elongated leaf 102. Accordingly, the engaging force of the end edge of the lever 107 on the tape can be hardly constant in accordance with the pressing and sliding condition between the tape 104 and the wall surface to cause irregular sliding of the end edge 107*c* of the lever on the tape surface and thus to shorten the sending length of the tape. Also when the pusher returns, the engaging force of the end edge of the lever is not completely released and thus the tape is pushed back to some extent resulting in shortening the sending length of the tape. Accordingly, it was found that the depth of the insertion is decreased to ease the slipping out of the inserted tape.

Furthermore, when the tape is pushed forward by the unstable engaging force of the end edge of the lever and the pushing force of the elongaged leaf 102 at the front end, the cross section of the guide path 101*a* provided in the guide plate 101 should be sufficiently large to decrease the resistance agianst the movement. Accordingly, the shape of its cross section is such that a rectangle is combined on an upset isosceles trapezoid. In this structure, the top of the upset isosceles trapezoid is open and the space of it is far larger than the total of the thickness of the elongated leaf and that of the tape and the isosceles portion is narrowed gradually to the lower opening.

Accordingly, when the elongated leaf is driven to forward together with the tape by pushing forward the pusher for the tape insertion, the folded portion of the tape going to be inserted to the front end wall of the stack is bended for several steps in the sending direction in the guide path by the resistance caused by the upper portion of the stack. Further, the elongated leaf is pressed on the isosceles portion from inside and is deformed so that it is also bent outward and protruded from the opening when the leaf is bent in the sending direction. It was found that these bending and deformation occured at every insertion process resulting in breaking the elongated leaf by fatigue.

DISCLOSURE OF THE INVENTION

An object of the present invention is to provide a paper inserting apparatus which causes no slippage of the inserted tape or "inserted paper" and can be used continuously for a very long period.

To accomplish the above object, the paper inserting apparatus of the present invention is constituted as follows. The paper inserting apparatus comprises: a guide bar having a flat guide path containing an upper and a lower surfaces extending parallel to and facing each other for the inserting tape supplied from its source; a tape pusher equipped to said guide bar so as to move slidably thereon within a defined range in the longitudinal direction of the bar, said tape pusher having an engaging means movable longitudinally through said guide path for engaging the tape from both the upper and a lower sides by being inserted to said guide path through said upper and lower surfaces and an elongated flexible elastic sheet or "leaf" which can slide the lower surface of the tape on said guide path and folds and drives the free portion of the tape protruded from the end edge of the guide path at the end of said guide bar; and reciprocal drive means operatively connected to said tape pusher for sliding it within said defined range; and said apparatus is characterized in that said guide bar is equipped at a position in relation to said cut sheet stack so that the tape pushed by said engaging means and the end of said elongated leaf in the forward movement of the pusher is inserted by a defined distance into the cut sheet area on the upper side of the top sheet held on a substantially defined level of the sheet stack waiting for the succeeding cut sheet upon counting-up the defined number of the sheets while the folded portion is held as the front end; and a non-return blade is provided in the rear portion of said guide path which allows the forward movement of the tape but prevents the backward movement of it, thereby when said engaging means is released and also said pusher is moved backward, so that only said elongated leaf is moved backward together with the pusher and the free portion of the tape including the folded portion is remained in said area insertion position.

According to the above constitution, the tape is driven forward surely by the engaging means and brought to said area insertion position and, during the backward movement of the elongated leaf, it is not driven backward as it is stopped with the non-return blade and the free portion of the tape positioned at said area is pressed by the cut sheets piled after that time resulting in forming a division from the lower stacklet by the insertion of the tape. And, because such an insertion is performed synchronized with the count of a defined number of the sheets in the sheet stack, it forms a trap running the side wall of the stack.

According to another aspect of the present invention, in addition to the above-fundamental constitution of the paper inserting apparatus, it is equipped with a stroke adjusting mechanism by which, the reciprocal strokes of the pusher and the elongated leaf is made adjustable to fit the tape insertion to the thickness of the stacklet.

According to further aspect of the present invention, in addition to the above-mentioned constitution, the paper inserting apparatus is equipped with a marking device to give a mark on the exposed surface of the tape between each insertions at each stacklet divided by the insertions to specify the stacklet, for example, to show the presence of defective sheets, etc. synchronized with the movement of the tape.

Further objects and advantages of the present invention will be made more apparent from the following detailed description refering to the drawings attached hereto.

Figure 10:
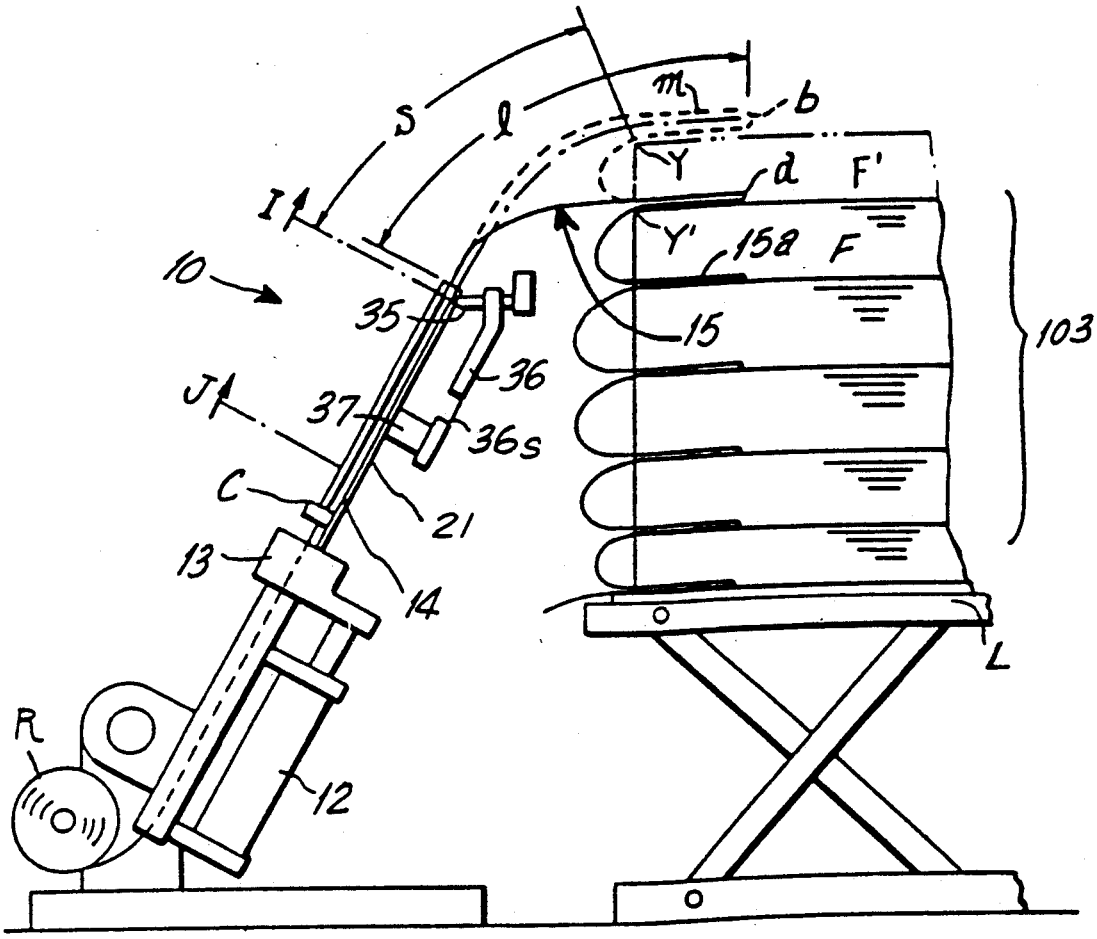
Figure 11:
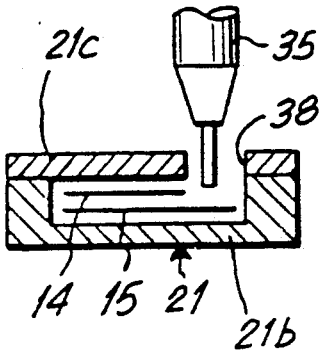
Figure 12:
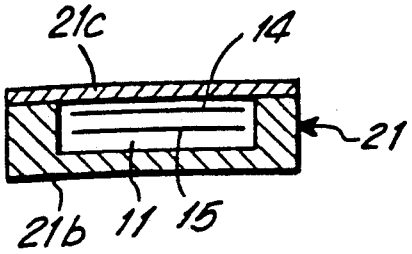
Figure 13:
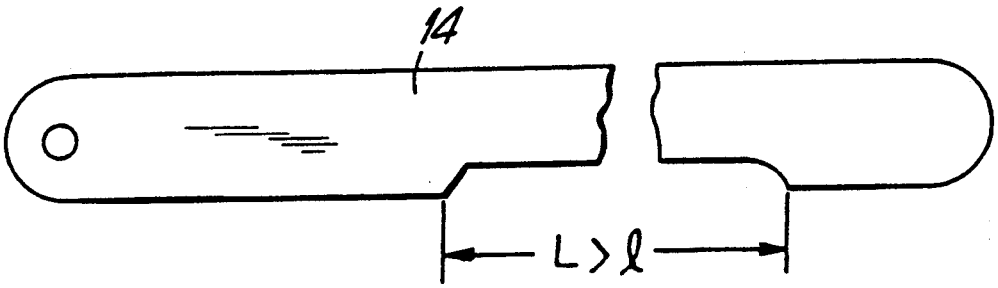
Figure 14:
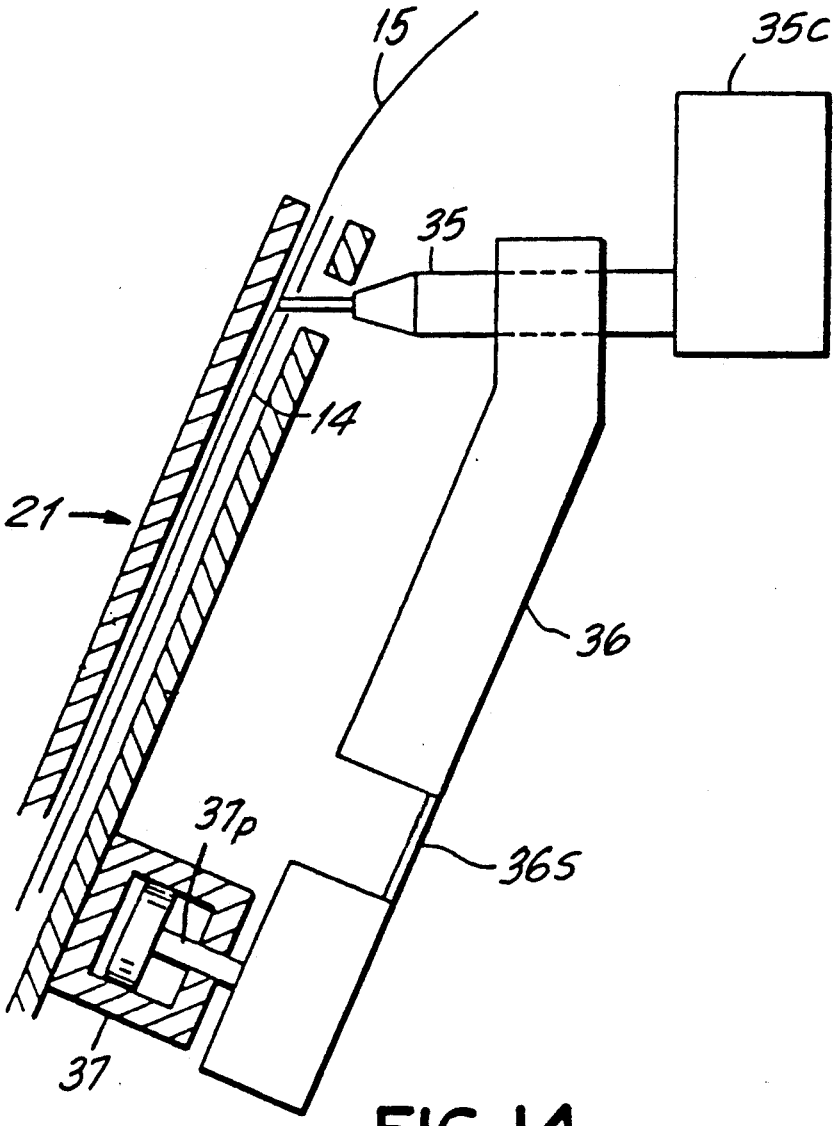
Figure 15:
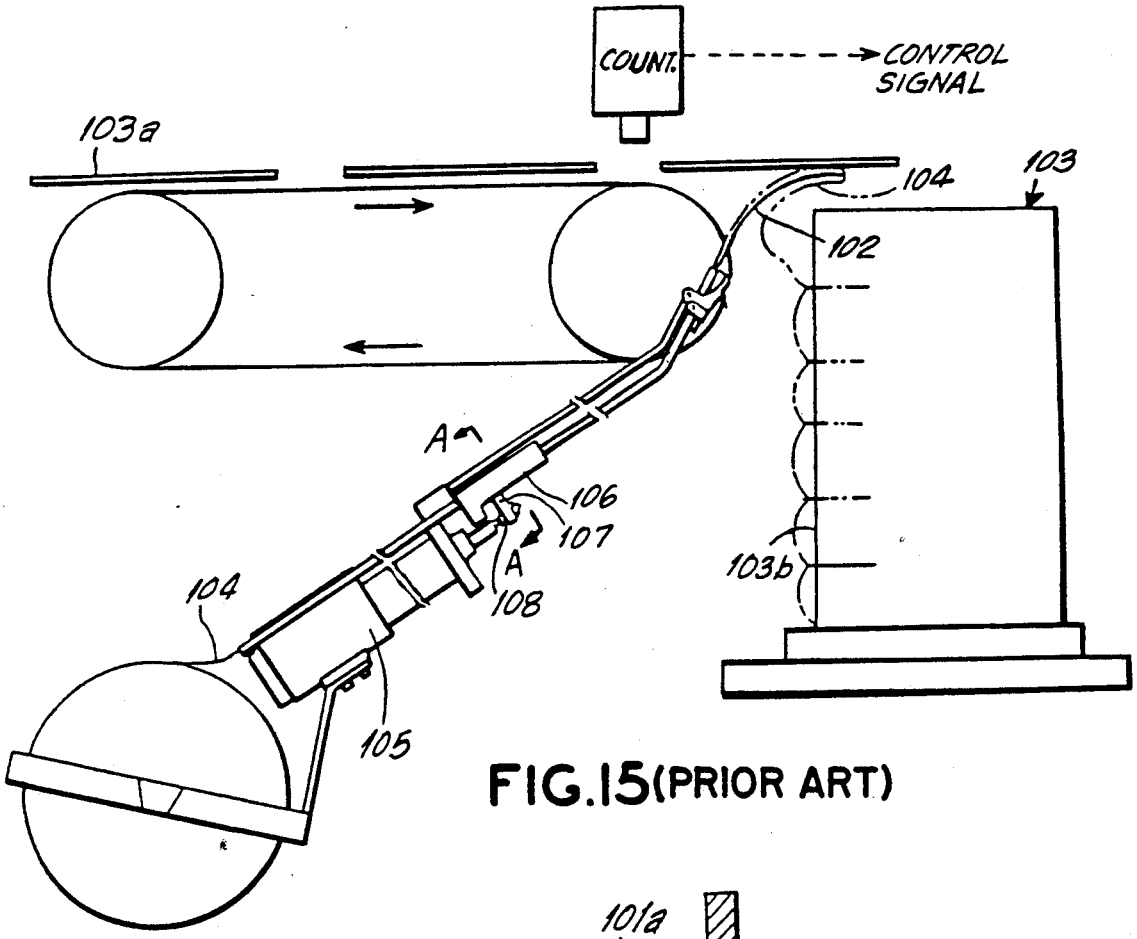
FIG.15(PRIOR ART)
Figure 16:
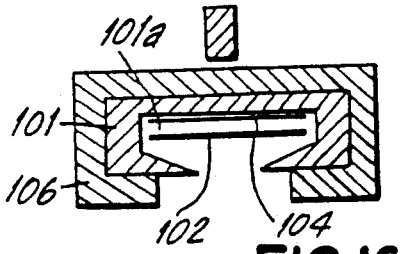
FIG.16(PRIOR ART)

FUG. 9 is a drawing illustrating the bending form of the elongated leaf in the case the interval of insertion becomes large at a constant tape feed length;

FIG. 10 is a side view of an embodiment of a paper inserting apparatus equipped with a marking mechanism constituted according to the present invention;

FIGS. 11 and 12 are cross sectional views showing respectively the section I and section K of the guide portion of the paper inserting apparatus of the embodiment shown by FIG. 10;

FIG. 13 is a plan view of the elongated flexible elastic leaf of the embodiment;

FIG. 14 is a side view of the pen and associated elements of the embodiment;

FIG. 15 is a total view of an embodiment of the conventional paper inserting apparatus;

FIGS. 16 is an enlarged view of the section A—A of FIG. 15; and

Figure 17:
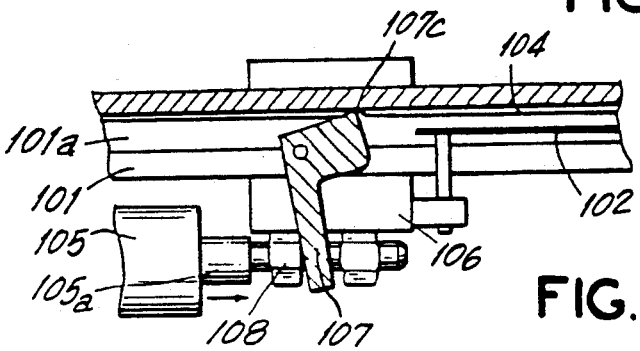
FIG.17(PRIOR ART)

FIG. 17 is a partial longitudinal cross sectional view of the tape sending mechanism of the pusher.

PREFERRED EMBODIMENT

Figure 1:
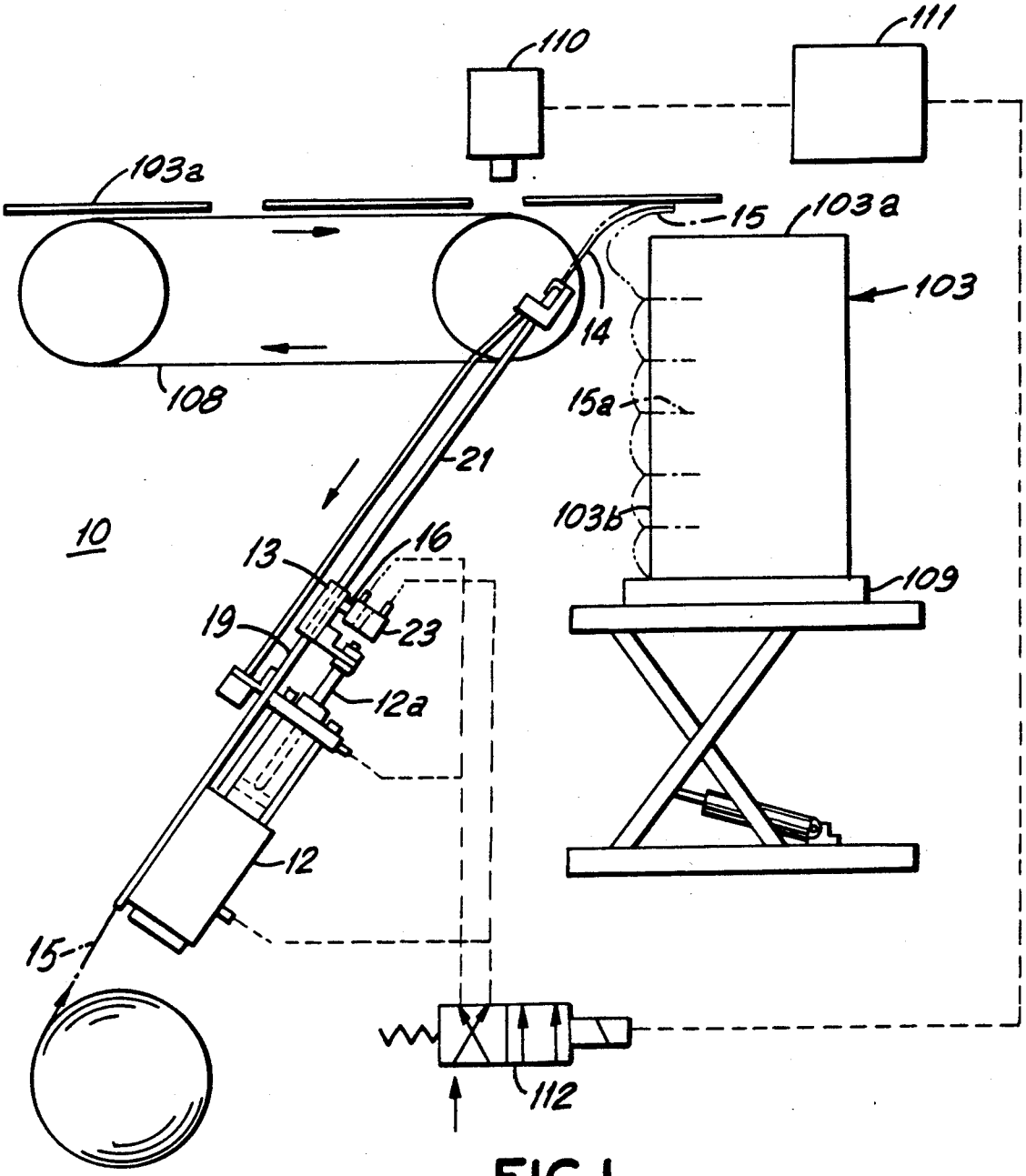
FIG. 1 is a side view outlining an embodiment of the paper inserting apparatus according to the present invention which is positioned facing to the end wall of the cut sheet stack piled on the platform.

The paper inserting apparatus of the basic example of the present invention will be illustrated in detail refering to FIG. 1.

Figure 2:
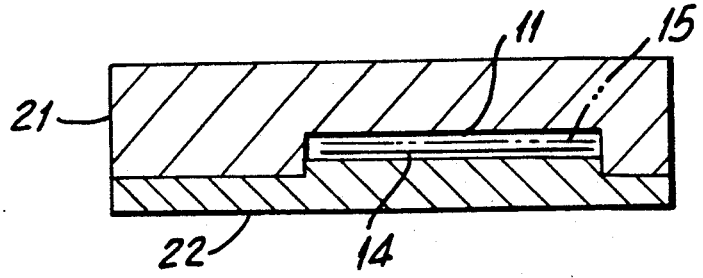
FIG. 2 is a cross sectional view of the guide bar in the paper inserting apparatus.

As shown in FIG. 1, the paper inserting apparatus 10 according to the present invention has in its front portion an elongated guide bar 21 having in the longitudinal direction a guide path 11 of a rectangular cross section, for example, of not more than 8 mm high as shown in FIG. 2 to guide the tape 15 and the elongated leaf 14. Also, as shown in FIG. 1, it has a pusher 13 in its central portion to push the tape and the elongated leaf to the inserting position slidably along the guide path. This pusher is driven by the movement of the rod 12*a* of the pusher driving cylinder 12 fixed to a frame not shown in the figure. Accordingly, the rod 12*a* moves intermittently for a defined tape length as one stroke.

Figure 3:
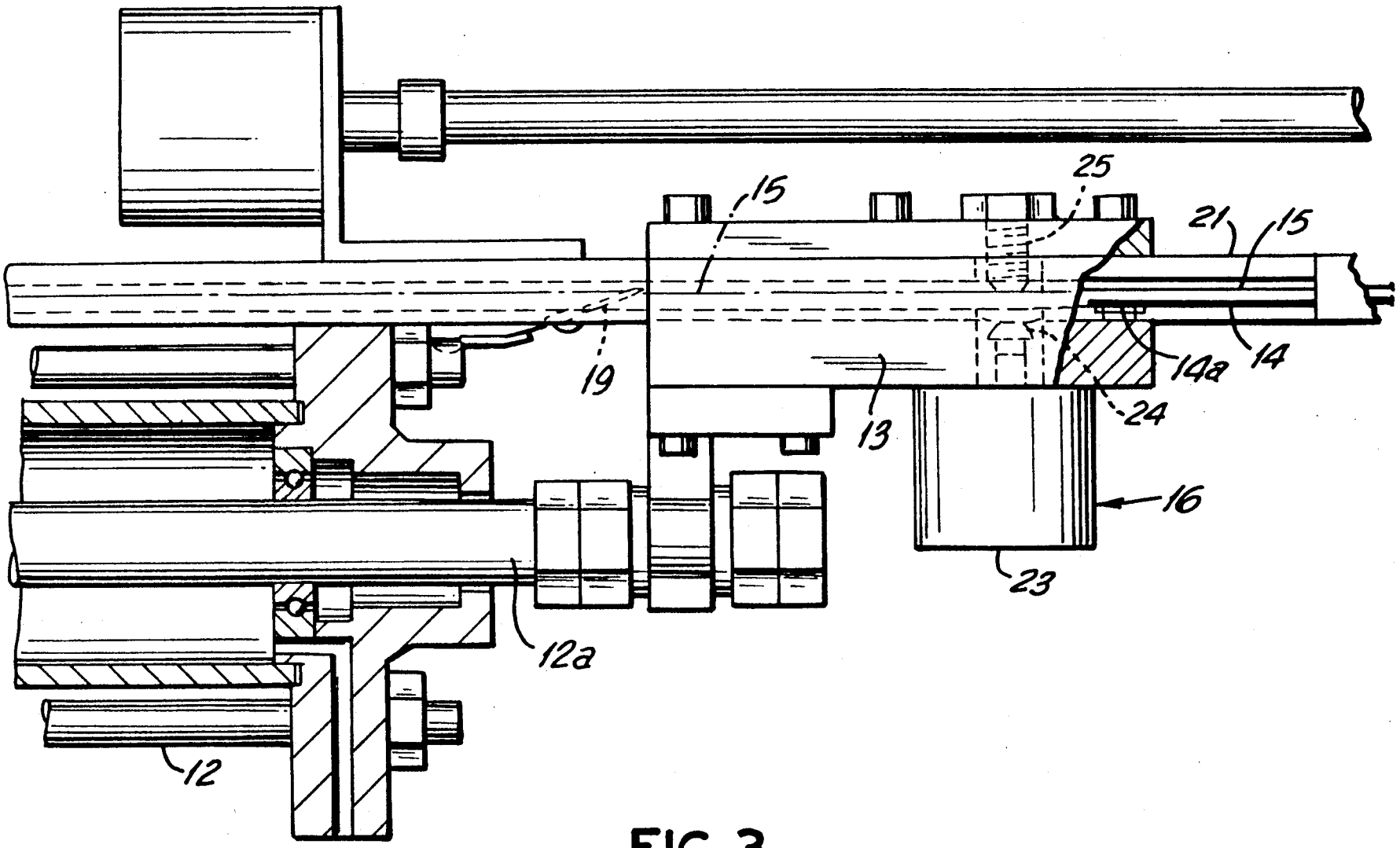
FIG. 3 is a partial side view of the arrangement of the main parts of the present invention, the engaging device and the tape non-return device, shown horizontally.
Figure 4:
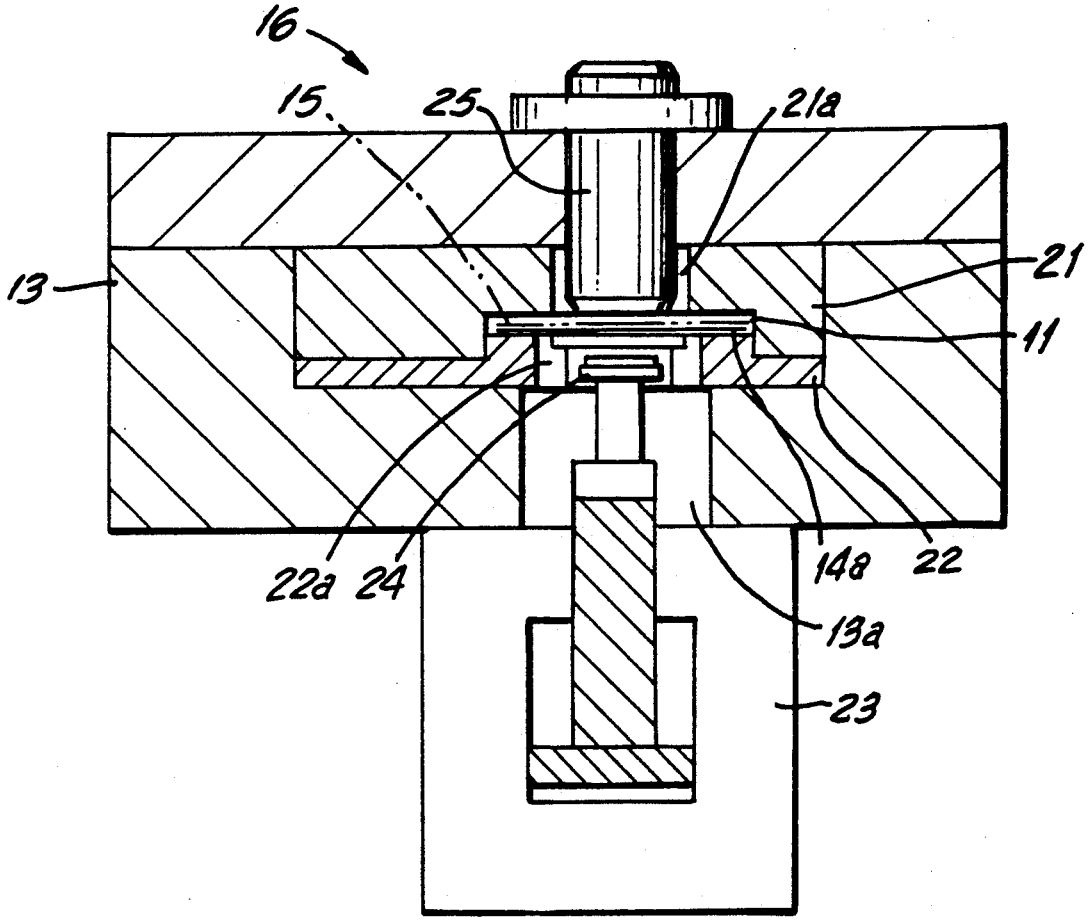
FIG. 4 is a cross sectional view of the pusher for illustrating detail of the engaging device.

An engaging device 16 is equipped to the pusher 13 to prevent the slippage of the tape 15 on the elongated leaf 14 during the pusher 13 is pushed forward to push the tape and the leaf to the inserting position as shown in FIG. 3. As shown in FIG. 4 in detail, the engaging device 16 has an engaging cylinder 23 fixed on the lower end surface of the pusher and a pressing block 24 fixed on the end of the piston rod extended from the cylinder is equipped so that it passes through the lower opening 13*a* of the pusher 13 and the groove 22*a* in the lower cover 22 of the guide bar 21 and extends from the lower side into the guide path. On the upper wall of the guide path, a fixed block 25 mounted on the pusher is equipped passing through the groove 21*a* of the guide bar so that its end extends from the upper side.

Accordingly, the pusher driving cylinder 12 and the engaging cylinder 23 are energized in linkage. Thus, the engaging cylinder is driven together with the forward movement of the pusher to press the tape between the pressing block 24 driven by the engaging cylinder 23 and the fixed block 25 and thus to engage the tape on the pusher. Thus, the fixed block 25 and the pressing block 24 move forward along the grooves 21*a* and 21*b* respectively formed in the guide bar 21 and the lower cover 22 together with the forward movement of the pusher 13 to push the tape 15. The rear end 14*a* of the elongated leaf 14 is fixed forward of the pressing block 24, preferably near the front end of the pusher not to inhibit the tape stoppage by the presing block. On the other hand, when the pusher is returned to the original position after the completeion of insertion 15*a*, the rod of the engaging cylinder is moved backward to release the tape and thus the sending length of the tape stabilized and slipping difficulty can be avoided.

Figure 5:
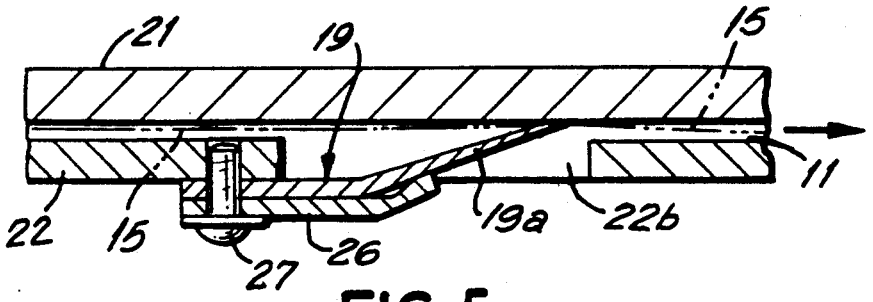
FIG. 5 is a partial longitudinsl sectional view of the guide bar for illustrating detail of the tape non-return device.

Further, as shown in FIG. 3, a tape non-return device 19 is equipped behind the pusher 13 (left in the figure) to prevent the slippage of the tape 15 from the inserted position by the friction of the elongated leaf when the pusher 13 is moved backward. The detail of the device is as shown in FIG. 5 such that a resilient plate 19*a* having an end to the direction of the forward tape movement bent in an obtuse angle is fixed to the cover 22 with a screw 27 through a pressing plate 26 so that it is extended to the direction of the forward movement of the pusher from the lower surface of the cover 22 and the end of the plate passes through the opening 22*b* of the cover 22 and extends into the guide path and presses the lower side of the tape to constitute a tape non-return device 19.

The method for the use of the paper inserting apparatus according to the present invention will be illustrated in detail as follows.

Referring to FIG. 1, the sheets 103*a* cut into a defined shape and a defined dimension sent from the preceeding process is transferred on the platform 109 continuously with the conveyor 108 and piled on the platform. During the transfer of the cut sheets, the number of the sheets transferred is detected with the sheet number detector 110 and when the defined number of the sheets is transferred the control device 111 switches the solenoid valve 112 to the left port as shown in FIG. 1 according to the program previously set in the control device to actuate the pusher driving cylinder 12 and to push forward the pusher 13. Then, by pressing the elongated leaf 14 and the tape 15 supported by the leaf in an acute angle against the lower surface of the cut sheet immediately before piled on the cut stacklet 103, the elongated leaf and the tape are bent in a condition that the elongated leaf is placed along the lower side of the cut sheet and guided exactly to the inserting position.

At that time, the engaging cylinder 23 of the engaging device 16 is actuated in linkage to the action of the pusher driving cylinder to push forward the pressing block and thus the tape is pressed tightly between the pressing block 24 and the fixed block 25 to stop the tape with no slippage.

The inserted paper is surely folded by the weight of the cut sheets piled successively.

Then, the solenoid valve 112 shown in FIG. 1 is switched to the right port to push back the pressing block 24 of the engaging device 16 and to release the engaging force and then the resilient plate of the tape non-return device 19 is actuated to prevent the slippage of the tape from the end wall by the friction of the elongated leaf 14 when only the elongated leaf 14 is removed from the end wall surface 103*b* of the cut sheet stacklet 103.

By forming the above-mentioned guide path 11 into a rectangular shape having a height of, for example, not more than 8 mm in the case where a paper tape of usual thickness and an elongated leaf of slightly thicker than the tape are passed through, the breakage of the leaf can be prevented, otherwise it would occurred due to the bending and deforming of the leaf in the conventional process. In summary, even in the case the height of the guide path is made to be slightly larger than the total of the thicknesses of the elongated leaf and the paper sheet, the movement forward and backward of the elongated leaf becomes easy to give a remarkably high performance.

It is a preferred manner of the present invention to form the guide path in a rectangular shape as mentioned above. However, any shape can be adopted which has at least two walls extending parallel with each other to guide the tape and the elongated leaf piled each other and the distance between the two walls is reasonable for the thicknesses of the tape and the elongated leaf with no restriction to such a manner. For example, it may have a cross section of a parallelogram.

Also, in the apparatus shown in FIG. 1, in the case, for example the thickness of the cut sheet is increased or the defined number of the sheets is increased, the distance between the inserting positions becomes large, though the length of the tape sent by the stroke of the cylinder is constant and thus the depth of insertion of the folded tape end to the stacklet becomes small and thus the tape slips out from the end wall of the stack.

In such a case, it can be possible to keep always the insertion at a proper depth by adopting a variable stroke type pusher driving cylinder or providing a mechanism for changing the position of stroke end of the driving cylinder to adjust the stroke width.

The embodiments shown in FIGS. 6 to 9 are intended to solve the above-problems in the continuous paper inserting apparatus mentioned above. In this embodiment, the stroke length of the elongated flexible leaf for guiding the inserting tape on the sheet stacklet, hence that of the pusher, was made to be variable.

Naturally, the length of the tape from one insertion to the next insertion in a continuous paper insertion is same as that of the sending stroke of the elongated leaf. Hence, if the stroke of the elongated leaf is changed, the depth of the insertion of the paper can be held constant by changing the length of the tape for one pitch of the insertion.

In FIGS. 6 to 9, the portions shown by the referring numbers same as or similar to those in FIGS. 1 to 5 are same as or similar to those described above and the descriptions other than necessary items will be omitted.

The rear (lower) end of the guide bar 21 is supported by a movable supporting mechanism 31 equipped on the platform 30. The movable supporting mechanism 31 comprises an arm 33 pivotally supported around the horizontal axis 33*a* at the upper end of the leg 32 stood on the platform 30 and means (not shown) for adjusting the inclination of the arm 33. On the platform 30, a roll R supplying the tape 15 as the raw paper for the inserting paper is pivotally mounted. L is a table lifter and the sheets 103*a* cut into a defined dimension are sent successively and piled on it to form the stack 103. The table lifter L is controlled so that the upper surface of the stack 103 is always in an approximately same height.

Figure 6:
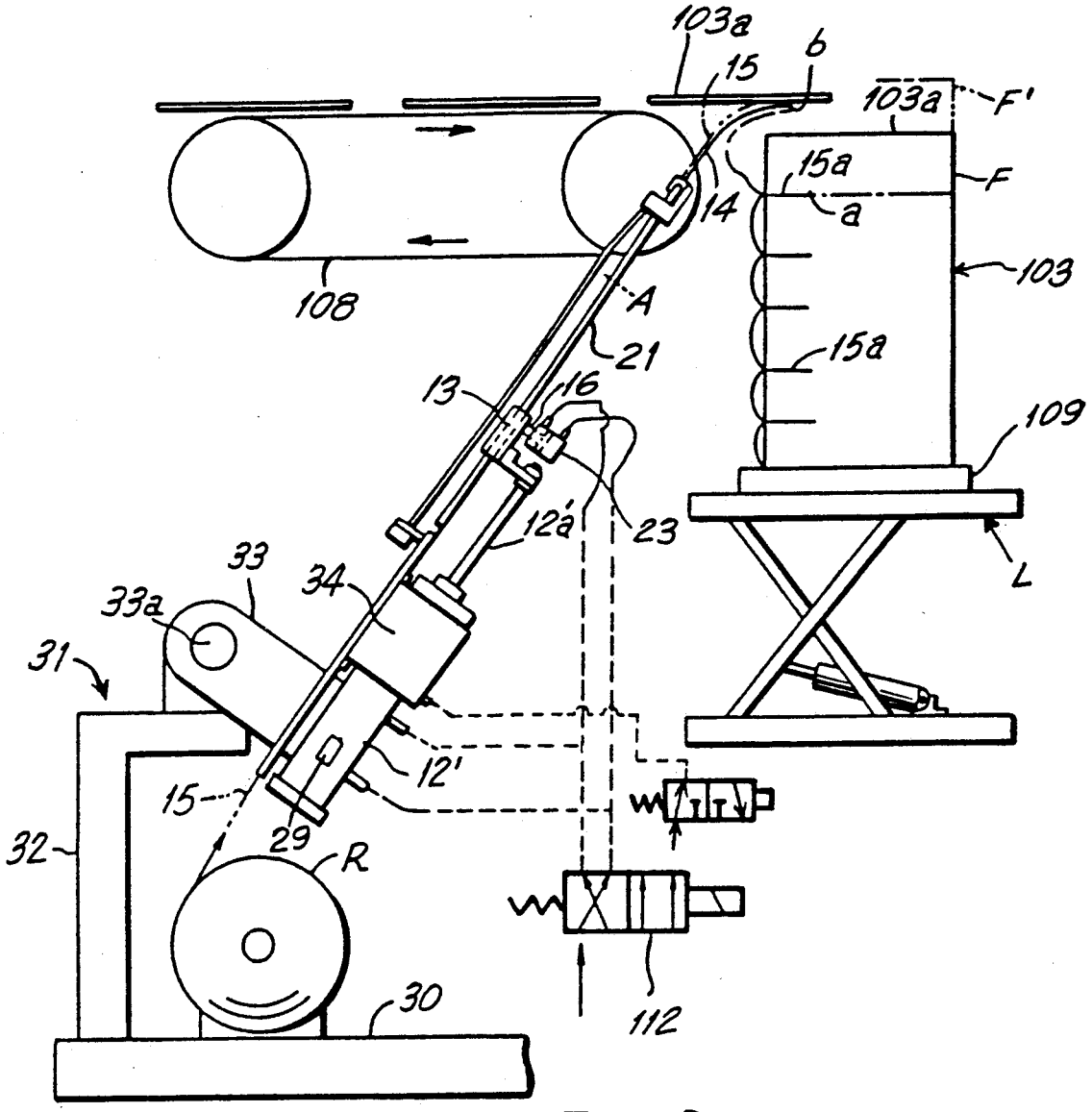
FIG. 6 is a side view of an embodiment of a paper inserting apparatus equipped with a stroke adjusting device constituted according to the present invention.
Figure 9:
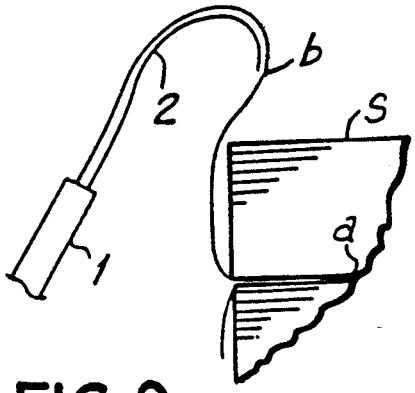
Figure 7:
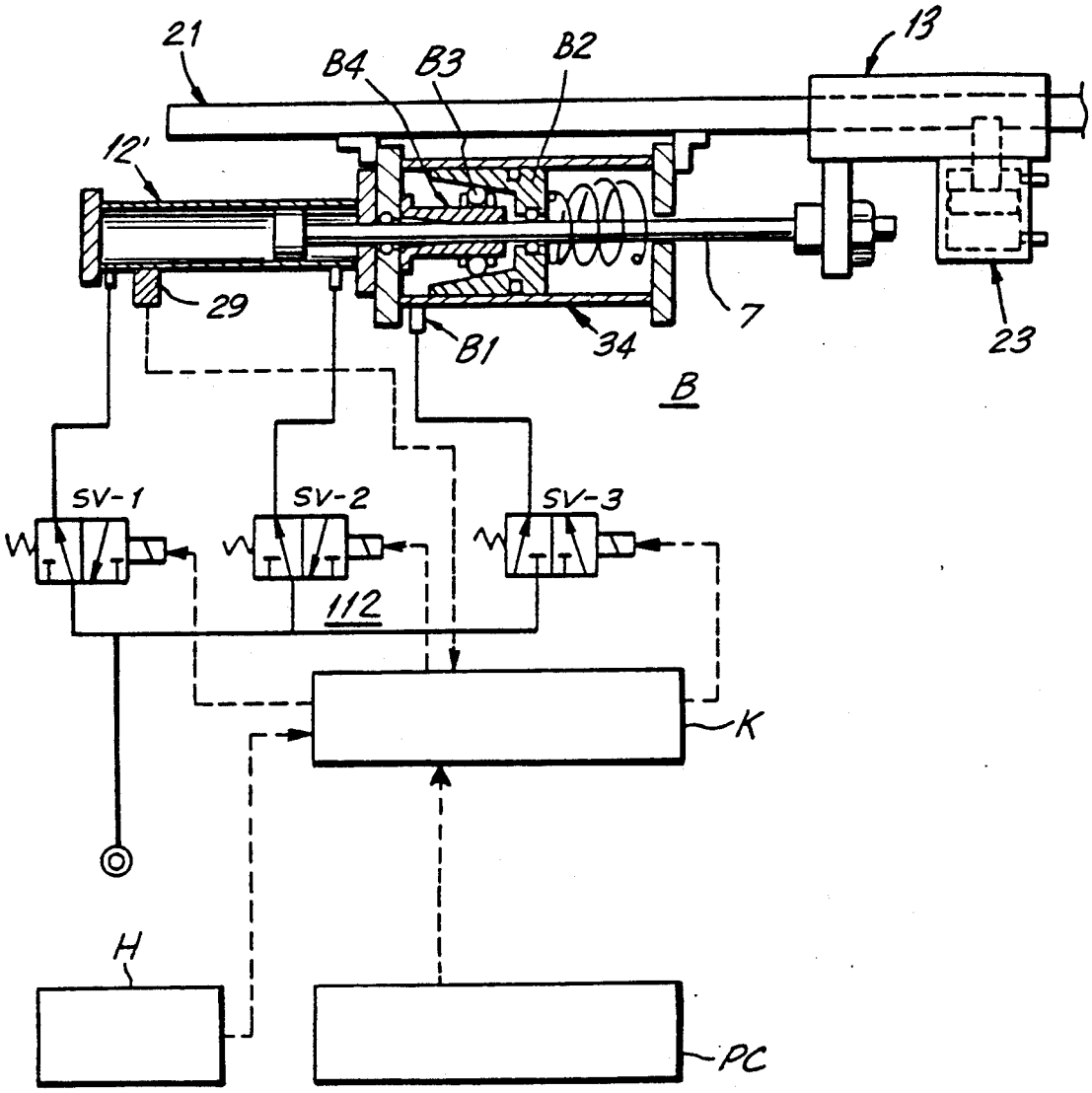
FIG. 7 is a longitudinal cross sectional view of an embodiment of the stroke adjusting mechanism.
Figure 8:
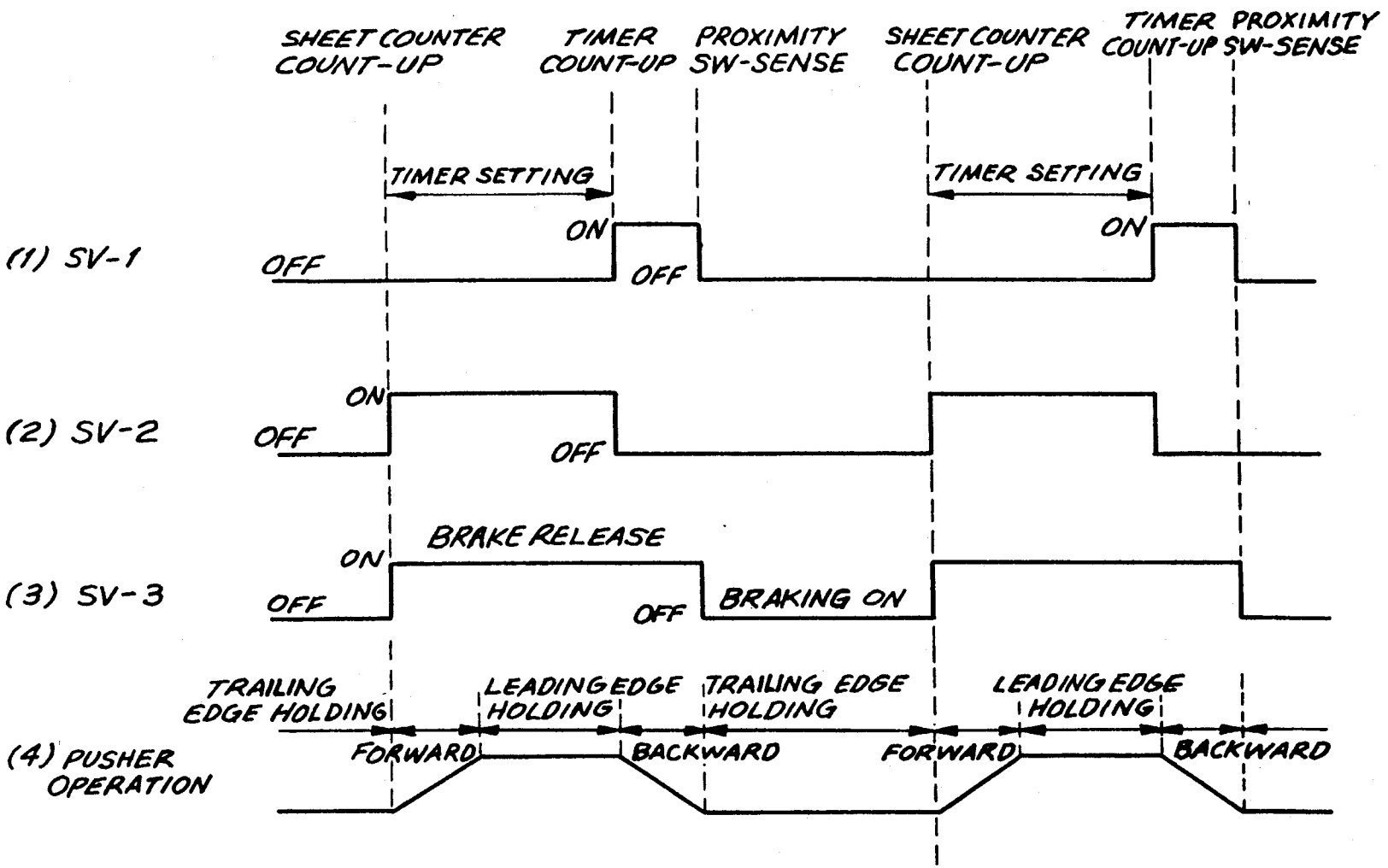
FIG. 8 is a time chart of the action of the above-mentioned embodiment.

In a normal manner, the position of the guide bar 21 of the paper inserting apparatus is controlled so that, at the end of forward stroke of the elongated leaf 14, the end of the elongated leaf 14 overlaps on the upper surface of the stack 103 by a defined length from its front end. In FIG. 6, the paper inserting apparatus is in a condition that it is ready for the insertion on the highest stacklet (pile of a defined number of sheets) F of the stack 103. The elongated leaf 14 is at the end position of the forward stroke and after this time the sheets are successively supplied to pile the next stacklet F′ on the inserted tape portion. The tape 15 including this inserted portion continues from the inserted portion 15*a* under the stacklet F to the supply roll R of the tape 15 going around the end of the elongated leaf 14. When the cut sheets are piled successively on the stacklet F in such a condition, the elongated leaf 14 bends by the weight of the sheets and is sandwiched between the stacklet F and the stacklet F′ formed on it together with the tape 15. The elongated leaf is pulled back when the weight of the stacklet F′ reaches a level. In this embodiment, the position of the end of backward stroke of the elongated leaf, that is the back stroke, can be set at will. After the elongated leaf is pulled back, the inserted paper 15*a* remains sandwiched between the stacklets F and F′. When the stacklet F′ reaches a certain height by a defined number of sheets, an insertion signal is provided by a proper control means to actuate the air cylinder 23 and the tape 15 of the raw inserting paper is cramped by the engaging device 16 and then the slide pusher 13 moves forward by the action of the air cylinder 12′ and the elongated leaf 14 is pushed forward to the end of the forward stroke together with the associated tape portion 15. Thus, after a new stacklet has been piled, only the elogated leaf is pulled back to the end of the backward stroke and prepared for the next insertion.

The pushed length of the inserting paper is equal to the forward stroke and also to the backward stroke of the elongated leaf and further to the length from the end (a) of the inserted paper 15*a* to the turning point (b) of the tape at the end of the elongated leaf. Accordingly, if the thickness of the stacklet, that is the distance between insertions, becomes larger than that shown in the figure, the pulled portion of the tape 15 is relatively shortened and thus bends the end of the elongated blade 14 downward to maintain the preceeding inserted paper portion 15*a*. As the result, the inserted paper cannot reach sufficient depth on the upper surface of the stack 103 and the insertion depth of the inserted paper becomes to be small. If the thickness of the stacklet is small, the linking portion between two insertions becomes longer to give a large sag in front of the stack which tends to be hooked by something approaching it to cause damage thereto. Thus in this embodiment, the end position of the backward stroke of the slide pusher 13 is made adjustable to set properly the pushing length of the inserting tape in accordance with the distance between insertions.

In the embodiment shown in the FIG. 6, an air cylinder 12′ equipped with a brake 34 is used as the pusher driving air cylinder and a magnetic proximity switch 29 is equipped positionally adjustable to the axis direction on the outer surface of the cylinder. In this case, the main body of the air cylinder is made of a nonmagnetic metal and the piston is made of a magnetic material such as iron and the proximity switch 29 detects the access of the iron piston from the outside of the cylinder. The piston rod is braked by this detection signal to stop the piston. Now, the variable stroke mechanism of the embodiment will be illustrated in more detail refering to FIGS. 7 and 8.

When the signal from the sheet number detector H reaches the number set by the preset counter PC, the pusher driving solenoid valve SV-2 is turned ON ("vent") by the control signal from the control device K and at the same time the brake actuating solenoid valve SV-3 is turned ON ("pressurize") to release the brake. The sliding pusher 13 is moved forward to insert the tape between the sheets and holds the front end at the end of the stopped elongated leaf 14 for a period set by the timer and during the period a plurality of the sheets is piled on the inserted tape to stabilize the inserted tape from slippage. When the period set by the timer is over, a signal from the control device turns ON ("vent") the pusher driving solenoid valve SV-1 and turns OFF ("pressurize") SV-2 and the pusher 13 begins to move backward. When the air cylinder piston reaches the back end set by the proximity switch 29, the switch 29 detects it and its signal turns OFF ("vent") the brake actuating solenoid valve SV-3 through the control device K to push backward the brake piston B2 in the brake 34 with the retainer spring and to shrink the brake shoe B4 and thus to press it on the piston rod to frictionally brake it. At the same time, it turns SV-1 OFF ("pressurize") to eliminate the driving force and to stop the piston and to maintain the back end position until the sheet number detector counts up next number.

When SV-3 is ON ("pressurize"), the brake device 34 supplies compressed air from the brake port B1 to move backward the brake piston B2 having a taper inside to the front direction of the guide bar 21 and thus releases the steel ball B3 from the taper. Thus, the centripetal pressure to the brake shoe B4 is released to make the piston rod freely slidable. When SV-3 is OFF, the compressed air is released from the brake port and the device brakes the piston rod with the friction of the brake shoe in a same manner as above. The position of the proximity switch 29 for setting the backward position of the stroke can be varied either manually or automatically by adding a moving mechnism of the limit switch 29 and an arithmetic control device for controlling and driving it to input the thickness data of the piled sheets and to optimize the position of the switch 29 from the product of the thickness and the set number of the sheets.

The rear end of the return stroke may be controlled by equipping a limit switch on the guide bar 21 and thus stopping the return stroke of the air cylinder 12' with the contact of the slide pusher 13. More mechanically, a screw having a protruded length corresponding to the screwed depth parallel to the guide bar 21 is fixed at the rear end of the slide pusher 13 and the head (lower end) of the screw is made to contact with the upper cylinder head of the air cylinder to adjust the rear stroke position.

In the above embodiment, the protruded length of the elongated leaf 14 from the guide bar 21 at the end of forward stroke is made constant and the position of the return stroke end is made adjustable. However, the protruded length of the elongated leaf at the forward stroke end (front end) may be adjusted to adjust the length of the forward stroke. Further, the positions of both ends of the reciprocal movement of the elongated leaf may be made adjustable.

After all, according to the above embodiment, the depth of insertion and the sag of the link between the adjacent insertions can be properly set regardless of the distance between the insertions in a continuous paper insertion to eliminate difficulties such as the slippage due to the lack in the depth of insertion and the too long link tending to be hooked by something.

The paper insertion is used to show the presence of defective sheets in addition to the purpose of identification of the stacklet of a defined number of sheets. In such a case, the inserting paper is marked to show the case. In the case of the previously cut inserting paper, its length is constant regardless of the thickness of the sheet to be treated and the number of the sheets. In such a case, the mark may be made at a length more than a defined value from the front end of the inserting paper (the range of penetration between the stacklets). However, in the case of an insertion using a continuous tape as in the present invention, if the pushed distance of the tape during the insertion cannot correspond completely to the required length of the inserting tape per one stacklet of the sheets decided by the distance between the stacklets for insertion (product of the thickness of the sheet and the number of the sheets,) even a marking on the inserting paper at a definite distance from the front end of the inserting apparatus causes a difficulty that the marking disappears by being penetrated between the sheets to compensate the difference in the length.

The embodiment shown in FIGS. 10 to 14 constitutes a paper inserting apparatus equipped with a marking means for the inserting paper by which the marks surely appear on the exposed portion of the tape in the continuous paper inserting apparatus. In these figures, the portions having the reference numbers same as or similar to those in FIGS. 1 to 9 are same as or similar to those described previously and illustrations other than necessary items will be omitted.

Refering to FIG. 10, as the main constitution for pulling the raw inserting paper tape on the upper surface of the elongated leaf 14 from the tape supply roll R by driving reciprocally the elongated flexible leaf 14 along the guide bar 21 in the paper inserting apparatus 10', an elongated thin leaf 14 and a cramp C associated to the pusher 13' are equipped to fix the tape 15 at the rear end of the elongated thin leaf 14. The height of the table lifter L is lowered as the cut sheets are piled on it successively in a same manner as in the embodiment previously mentioned to maintain the upper surface of the stack 103 at approximately constant height. FIG. 10 shows a stage when the stacklet F has been piled and the stacklet F' being piled on it.

The marking device is equipped to the paper inserting apparatus 10 and comprises a pen 35 and a mechanism for touching and detaching the pen to the inserting paper tape as the main constitution. The end of the pen 35 is arranged to touch to the inserting paper 15 from the side of the elongated leaf 14 and hence the mark line is written by the pen 35 on the outer side of the exposed portion of the inserted paper protruded from the stack. As shown in FIG. 11, the pen 35 contact to the portion of the inserting paper 15 protruded from the side edge of the elongated leaf 14 and the center portion of the arm 36 supporting the pen 35 is made of a leaf spring as shown especially in FIG. 14 to cushion the contact of the pen 35 on the inserting paper tape 15. The arm 35 is fixed on the plunger 37P of the air cylinder 37 equipped to the guide bar 21 of the paper inserting apparatus.

After all, the pen 35 is touched and detached to the inserting paper 15 by the action of the cylinder 37.

FIG. 11 shows the cross section I of the guide bar 21 in FIG. 10. FIG. 12 shows the cross section J of the guide bar 21 apart from the pen 35. The guide bar 21 comprises the main body **21*b* having a groove 11 through which the elongated thin leaf 14 and the inserting paper 15 pass and the groove cover 21*c*. As shown in FIG. 13, the pen side of the elongated leaf 14 (right side of FIGS. 11 and 12) is cut over the range of $L>l$ so that the pen 35 can contact to the inserting paper 15** exposed from this narrow portion. The character "l" designates the length of the movement of the elongated leaf, that is, of one push of the paper tape.

In FIG. 14, **4*c* is an ink cartridge which is equipped removable to the pen 35** and supplies ink to the pen.

Now, the marking action will be illustrated. In FIG. 10, when a marking signal is given to the stacklet F', the signal is kept until the next forward movement of the inserting paper is completed to contact the pen 35 on the inserting paper 15 by the actuation of the air cylinder 37. The control mechanism may be constituted so that the contact is started at the time the paper inserting signal is given after the marking signal is given. When the stacklet F' reaches the defined number of sheets and the paper inserting signal is given, the elongated flexible leaf 14 is pushed forward and the above-mentioned paper insertion is effected. At the time, as the pen 35 is contacted to the inserting paper 15, a line of same length as the push length l of the thin leaf 14, is drawn on the paper 15. In FIG. 10, the length of the inserting paper between the bent ends of the inserted paper at both sides of the stacklet F', point "a" and point "b", is l and the distance between the upper edge Y of the stack 103, and the pen 35 along the inserting paper is S. As $S>l$, the end of the line drawn on the inserting paper goes to the point m on the upper surface of the stack. Thus, the action of inserting the paper in the stacklet F' is no more than an action of arranging the inserting paper tape between the point "a" and the point "b". Hence, the length of the inserting paper between the point "a" and the point "b" is equal to l. Further, as the upper level of the stack on the table lifter is controlled constant, the length between the upper edge Y' of the preceding stacklet and the pen 35 is assumed to be equal to the length between the upper edge Y of the succeeding stacklet and the pen 35.

Hence, the end of the line drawn by the pen 35 during the inserting paper is pushed from the point a to the point b goes from the site of the pen to the point m over the length S. When the thin leaf 14 has been pushed completely, the forward movement is over and the retention of the marking signal is released and the pen 35 is detached from the inserting paper 15. When an inserting signal is given to the stacklet (not shown) to be piled on the stacklet F', the inserting paper portion on which the line was previously drawn by the pen 35 is inserted on the stacklet to be piled on the stacklet F' across the side of it and the mark line drawn by the pen is exposed on the side of the stacklet to show the marking signal is given to the stacklet F'.

In the paper inserting apparatus of the present invention, a continuous inserting paper is used and the mark is given on the inserting paper portion from one insertion to the next insertion in a line. Hence, such a phenomenon that the inserting paper penetrates into the stack to hide the mark cannot occur. Even if the depth of insertion fluctuates by the change in the height of the stack due to the imcompleteness of control of the upper level of the stack, such a phenomenon that the mark portion is hidden into the stack never occurs as the mark is drawn in a line. As the marking pen contacts to the inserting paper from the side the inserting paper faces to the side of the stack, the mark comes outside when the paper is inserted to prevent contamination of the sheet with marking ink.

What is claimed is:

1. A paper inserting apparatus, comprising: a guide bar having a flat guide path containing an upper surface and a lower surface, said surfaces extending parallel to and facing each other, for inserting tape into said guide path from a tape supply source, said tape having an upper side and a lower side;

a tape pusher slidably affixed to said guide bar so as to move slidably thereon, said tape pusher movable within a defined range of movement in the longitudinal direction of said bar;

engaging means affixed to said tape pusher for engaging said tape on both sides, said engaging means movable longitudinally along said guide path so as to insert said tape through said upper surface and said lower surface;

an elongated flexible elastic leaf for sliding said lower surface of said tape on said guide path, said leaf folding and driving the free portion of said tape as said free portion of said tape emerges from the end of said guide path; and reciprocal drive means to slide said tape pusher within said defined range of movement, characterized in that said guide bar is equipped at a position in relation to a cut sheet stack so that said free portion of said tape is inserted a predetermined distance into a cut sheet area at an insertion position on the upper side of a top sheet positioned at a predetermined level of said sheet stack, said tape remaining for a succeeding cut sheet to fall upon said cut sheet stack upon the counting-up of a defined number of the sheets while the folded portion of said tape is held by said elastic leaf against said top sheet; and a non-return blade is provided in the rear portion of said guide path which allows forward movement of said tape along said guide path but prevents backward movement thereof, such that engaging means is released and said pusher is moved backward, only said elongated leaf is moved backward together with said pusher, said folded portion of said tape remaining in said insertion position.

2. The paper inserting apparatus according to claim 1, further comprising a stroke adjustment mechanism to adjustably stop the movement of said pusher at a desired stroke end position, said stroke adjustment mechanism including means for braking said reciprocal drive means, such that the reciprocal cycles of the pusher and the elongated leaf are adjustable to insert said tape into said cut sheet stack according to the thickness of individual stacklets of said cut sheet stack.

3. The paper inserting apparatus according to claim 1, further comprising a marking device including a pen element connected to and in communication with an inking device for marking the surface of said tape exposed between each tape insertion at each stacklet on said cut sheet stack, said marking device further including means for synchronously driving said pen element from a retracted rest position with said surface of said tape to be exposed between each tape insertion, and a mounting flange for mounting said pen element with said inking device relative to said guide bar.

* * * * *